US006694951B2

(12) United States Patent
Frank

(10) Patent No.: US 6,694,951 B2
(45) Date of Patent: Feb. 24, 2004

(54) FUEL SUPPLY SYSTEM FOR AN INTERNAL COMBUSTION ENGINE WITH A HYBRID-DRIVE FUEL PUMP

(75) Inventor: Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/168,828

(22) PCT Filed: Dec. 8, 2000

(86) PCT No.: PCT/DE00/04368

§ 371 (c)(1),
(2), (4) Date: Oct. 15, 2002

(87) PCT Pub. No.: WO01/50012

PCT Pub. Date: Jul. 12, 2001

(65) Prior Publication Data

US 2003/0121503 A1 Jul. 3, 2003

(30) Foreign Application Priority Data

Dec. 29, 1999 (DE) ..... 199 63 719

(51) Int. Cl.[7] ..... F02M 37/00
(52) U.S. Cl. ..... 123/495; 123/497
(58) Field of Search ..... 123/495, 497

(56) References Cited

U.S. PATENT DOCUMENTS

| | | | | | |
|---|---|---|---|---|---|
| 5,507,266 | A | * | 4/1996 | Wright et al. | 123/497 |
| 6,253,739 | B1 | * | 7/2001 | Golomb et al. | 123/509 |
| 6,539,926 | B2 | * | 4/2003 | Hakansson et al. | 123/495 |
| 6,543,425 | B2 | * | 4/2003 | Mayer et al. | 123/495 |
| 2001/0011537 | A1 | * | 8/2001 | Joos et al. | 123/497 |
| 2003/0183205 | A1 | * | 10/2003 | Mudway et al. | 123/497 |

* cited by examiner

*Primary Examiner*—Thomas N. Moulis
(74) *Attorney, Agent, or Firm*—Ronald E. Greigg

(57) ABSTRACT

A fuel supply system for internal combustion engines has a fuel pump that can be driven both by an electric drive and by the engine. The result is good starting performance of the engine and low demand for driving power on the part of the fuel pump during operation of the engine.

20 Claims, 1 Drawing Sheet

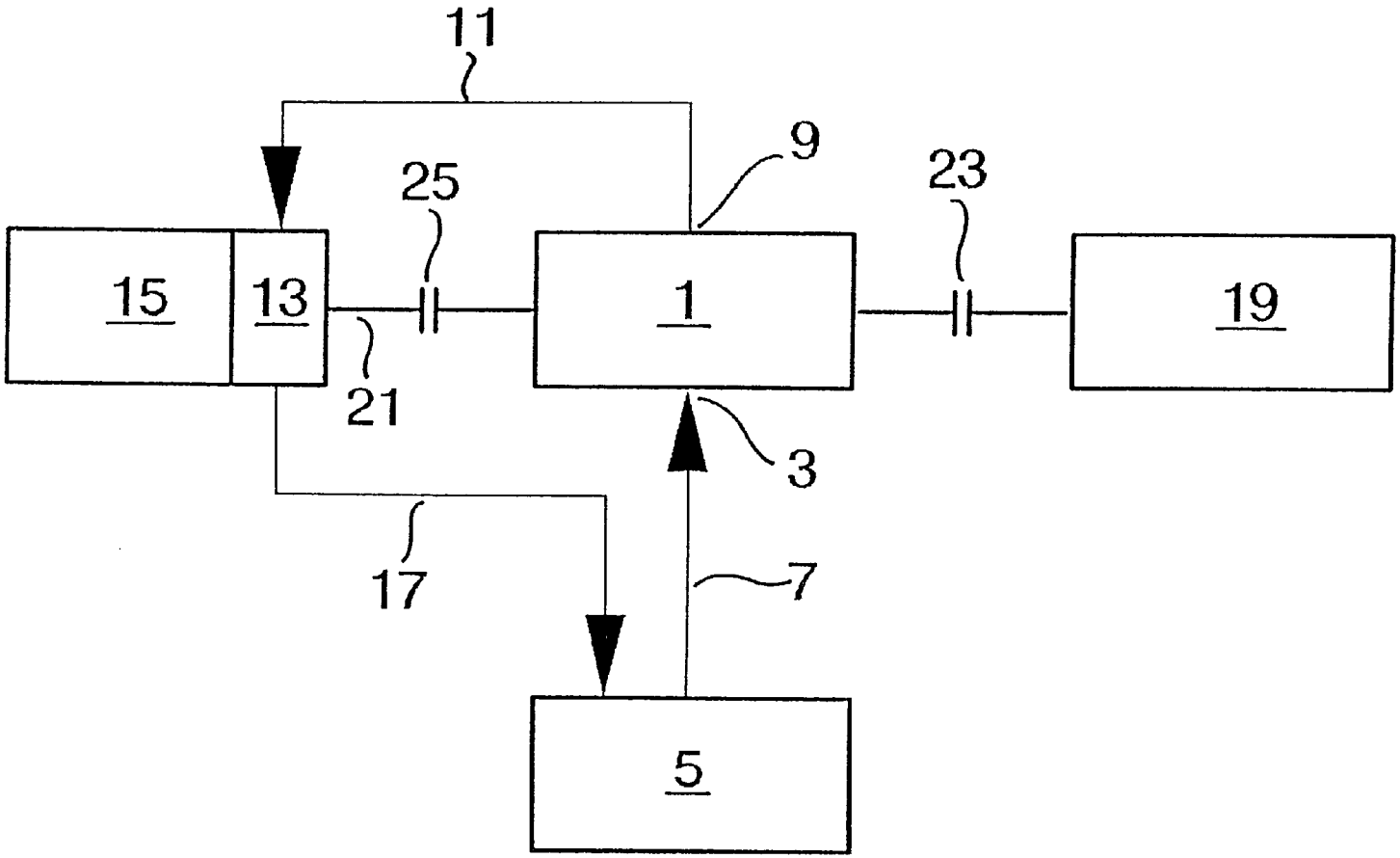
19
23
9
1
3
7
5
11
25
21
17
13
15

FUEL SUPPLY SYSTEM FOR AN INTERNAL COMBUSTION ENGINE WITH A HYBRID-DRIVE FUEL PUMP

CROSS-REFERENCE TO RELATED APPLICATIONS

This application is a 35 U.S.C. 371 application of PCT/DE 00/04368, filed on Aug. 12, 2000.

BACKGROUND OF THE INVENTION

1. Field Of The Invention

The invention is based on a fuel supply system for internal combustion engines, having an electrically driven fuel pump, in which the intake side of the fuel pump in fluid communication with a fuel tank, and the compression side of the fuel pump in fluid communication with the engine.

2. Description Of The Prior Art

In a known fuel supply system, an electrically driven fuel pump pumps the fuel from the fuel tank to the engine. The electric drive of the fuel pump must be designed for the entire operating life of the engine. This means that upon engine starting if the battery is weak or it is very cold outside, the pumping capacity of the fuel pump is reduced markedly, since the voltage in the on-board electrical system drops to about 50% of the rated voltage. Consequently the fuel supply to the engine and thus the starting performance of the engine are not optimal. Furthermore, since the known electric drives are not regulated, the pumping flow of the fuel pump is always the same as the maximum fuel flow required. In idling or at partial load, the excess fuel is returned to the fuel tank via a return line. This means an unnecessarily high consumption of electrical energy for driving the fuel pump. Finally, the electric drive and the fuel pump become unnecessarily expensive.

It is also known to couple a fuel pump directly to the engine and to drive it by the engine. The advantage of this drive concept is due to the fact that the pumping capacity of the fuel pump is approximately proportional to the engine rpm and thus also approximately proportional to the fuel consumption of the engine. Thus the fuel flow that is returned to the tank via a return line, and the drive power required for the fuel pump, are reduced markedly also. A disadvantage of this drive concept, however, is that upon starting of the engine, the fuel pump furnishes only a very slight pumping flow, so that it requires several revolutions of the crankshaft of the engine to reach the requisite pressure buildup, for instance, in the fuel injection system of the engine. The result is poor starting performance. Another disadvantage of this system is that if the tank is empty, or the first time the tank is filled at the factory, the engine starter must be actuated for a long time to attain the requisite fuel pumping. This puts heavy loads on both the battery and the starter.

OBJECTS AND SUMMARY OF THE INVENTION

The primary object of the invention is to furnish a fuel supply system with an improved operating performance compared to the prior art.

According to the invention, this object is attained by a fuel supply system for internal combustion engines, having an electrically driven fuel pump, in which the intake side of the fuel pump is in the fluid communication with a fuel tank, in which the compression side of the fuel pump is in the fluid communication with the engine, and in which the fuel pump is alternatively driven by the engine.

As a result of the hybrid drive of the fuel pump, the advantages of both drive systems can be exploited without doing so at the cost of their disadvantages. Upon starting of the engine, the fuel pump is driven electrically, so that despite a low crankshaft rpm of the engine, an adequate pumping flow is achieved, and thus the engine is supplied with fuel sufficiently quickly. The result is both good starting performance and a low load on the starter battery and the starter. These advantages also pertain the first time the fuel tank is filled at the factory, or if the fuel tank has been empty.

As soon as the engine is running at a sufficiently high rpm, the drive of the fuel pump is taken over by the engine. As a result, the fuel pump rpm is coupled directly to the engine rpm. An improved match between the pumping flow of the fuel pump and the fuel consumption of the engine is thus attained. This meets the need for fuel pumping suitable for demand. It moreover avoids returning large portions of the fuel pumping flow to the fuel tank via a return line. As a result of the direct drive of the fuel pump, the efficiency is also increased, since there is no need to convert the driving power via the generator and the electric drive.

In a further feature of the invention, it is provided that the electric drive of the fuel pump is a brushless electric motor, so that as soon as this drive is switched to be currentless, and the fuel pump is driven by the engine, it can run along with the engine without a significant power loss. The result is an especially simple, economical design of the fuel supply system of the invention. Furthermore in this embodiment, especially quiet operation is achieved when the fuel pump is driven by the engine.

In a variant of the invention, it is provided that the electric drive will still function at half the rated voltage of the on-board electrical system, so that even if the starter battery is weak or its capacity is reduced because of low temperatures, an adequate pumping capacity of the fuel pump is still attained. This design is unobjectionable from the standpoint that the fuel pump is electrically driven only during the starting events, and not during the entire operating time of the engine. As a result, the operating time is reduced to a fraction of that of the engine, so that even in brief operation of the electric drive at the rated voltage of the on-board electrical system, no overload ensues.

In further variants of the invention, it is provided that a freewheel is disposed between the electric drive and the fuel pump, and that a second freewheel is disposed between the engine and the fuel pump, so that the fuel pump is driven either by the electric drive or by the engine, and a reversal of the power flow, for instance from the fuel pump to the engine or from the fuel pump to the electric drive, cannot occur. This enhances the operating reliability and minimizes the energy demand for the fuel pump.

Further features of the invention provided that the drive of the fuel pump is effected on the engine side by the camshaft, the crankshaft, a toothed belt, a V-belt, a control chain, the drive for the water pump or for the generator, or the high-pressure fuel pump of a fuel injection system, so that an optimal adaptation of the pumping quantity of the fuel pump becomes possible. For instance, the camshaft rotates at only half the rpm of the crankshaft, so that depending on which shaft the fuel pump is driven by, the rpm differs by the factor of 2. The rpm ratio between the engine and the fuel pump can be selected as virtually fixed by driving the fuel pump via a toothed belt, V-belt or control chain. Another criterion for the choice of the drive of the fuel pump in terms of the engine can be the structural conditions existing in the region of the engine, or making assembly as simple as possible.

BRIEF DESCRIPTION OF THE DRAWINGS

Other advantages and advantageous features of the invention will become apparent from the description contained below, taken with the single FIGURE of the drawing which schematically shows the fuel system of the invention along with an internal combustion engine.

DESCRIPTION OF THE PREFERRED EMBODIMENT

A fuel pump 1 communicates on its intake side 3 with a fuel tank 5 via a first low-pressure fuel line 7. The compression side 9 of the fuel pump 1 is in fluid communication via a second low-pressure fuel line 11 with a fuel injection pump 13 of an internal combustion engine 15. Excess fuel pumped to the engine 15 by the fuel pump 1 is returned to the fuel tank 5 again via a return line 17. Pump 1 may be a known roller cell pump or a gear pump, for example.

The fuel pump 1 is alternatively driven by an electric drive 19 or a power takeoff shaft 21 of the injection pump 13. Between the electric drive 19 and the fuel pump 1, a first freewheel 23 is provided. Between the engine 15, or the power takeoff shaft 21 of the injection pump 13, and the fuel pump 1, a second freewheel 25 is provided. By means of the freewheels 23 and 25, the fuel pump 1 is prevented from being driven simultaneously by both the engine 15 and the electric drive 19. Moreover, a reversal of the power flow from the fuel pump 1 to the engine 15, or from the fuel pump 1 to the electric drive 19, is prevented.

The electric drive 19 is triggered upon initiating starting of the engine 15. As a result, the pumping flow of the fuel pump 1 is independent of the rpm of the engine 15, so that the engine is quickly supplied with sufficient fuel. This is especially important if the tank has run empty or when the tank is filled for the first time at the factory.

As soon as the engine 15 is running at a high enough rpm, the electric drive 19 is switched to be currentless, and the fuel pump 1 is driven by the engine 15. As a result, a pumping flow of the fuel pump 1 that corresponds to the fuel consumption of the engine 15 is attained, so that only little fuel has to be returned to the tank 5 by the engine 15 or the fuel injection pump 13 via the fuel return line 17. Hence the fuel supply system of the invention leads to very good starting performance of the engine 15, even under difficult conditions, and to a reduction in the driving power demand of the fuel pump 1 during the operation of the engine 15, so that the fuel consumption of the engine 15 is reduced accordingly.

Because the operating time of the electric drive is reduced markedly compared to that of the engine, the electric drive can be designed such that it is still functional even at only about half the rated voltage of the on-board electrical system. As a result, even if the starter battery is weak or its capacity is reduced because of low temperatures, an adequate pumping capacity of the fuel pump is still attained.

The drive in terms of the engine of the fuel pump 1 by a power takeoff shaft 21 of the fuel injection pump 13 is only one possible drive option, among many. The drive of the fuel pump 1 in terms of the engine can also be done by the camshaft, the crankshaft, a toothed belt, a V-belt, a control chain, or by the drive of the water pump or of the generator. An optimal adaptation of the pumping quantity of the fuel pump, or the given structural conditions in the region of the engine, and simplification of assembly can be attained by the suitable choice of the drive in terms of the engine.

The foregoing relates to preferred exemplary embodiments of the invention, it being understood that other variants and embodiments thereof are possible within the spirit and scope of the invention, the latter being defined by the appended claims.

What is claimed is:

1. A fuel supply system for an internal combustion engine (15), comprising an electrically driven fuel pump (1) having an intake side (3) connected in fluid communication with a fuel tank (5), a compression side (9) connected in fluid communication with the engine (15), and, means (21,25) for alternatively driving the fuel pump (1) by the engine (15).

2. The fuel supply system of claim 1 wherein the electric drive (19) of the fuel pump (1) is a brushless electric motor.

3. The fuel supply system of claim 1 wherein the electric drive (19) is still functional at half the rated voltage of the on-board electrical system.

4. The fuel supply system of claim 2 wherein the electric drive (19) is still functional at half the rated voltage of the on-board electrical system.

5. The fuel supply system of claim 1 further comprising a first freewheel (23) disposed between the electric drive (19) and the fuel pump (1).

6. The fuel supply system of claim 2 further comprising a first freewheel (23) disposed between the electric drive (19) and the fuel pump (1).

7. The fuel supply system of claim 3 further comprising a first freewheel (23) disposed between the electric drive (19) and the fuel pump (1).

8. The fuel supply system of claim 1 further comprising a second freewheel (25) disposed between the engine (15) and the fuel pump (1).

9. The fuel supply system of claim 2 further comprising a second freewheel (25) disposed between the engine (15) and the fuel pump (1).

10. The fuel supply system of claim 3 further comprising a second freewheel (25) disposed between the engine (15) and the fuel pump (1).

11. The fuel supply system of claim 5 further comprising a second freewheel (25) disposed between the engine (15) and the fuel pump (1).

12. The fuel supply system of claim 1 wherein the drive of the fuel pump (1) is effected on the engine side by the engine camshaft, the crankshaft, a toothed belt, a V-belt, the drive for the water pump or for the generator, or the high-pressure fuel pump (13) of a fuel injection system.

13. The fuel supply system of claim 2 wherein the drive of the fuel pump (1) is effected on the engine side by the engine camshaft, the crankshaft, a toothed belt, a V-belt, the drive for the water pump or for the generator, or the high-pressure fuel pump (13) of a fuel injection system.

14. The fuel supply system of claim 3 wherein the drive of the fuel pump (1) is effected on the engine side by the engine camshaft, the crankshaft, a toothed belt, a V-belt, the drive for the water pump or for the generator, or the high-pressure fuel pump (13) of a fuel injection system.

15. The fuel supply system of claim 5 wherein the drive of the fuel pump (1) is effected on the engine side by the engine camshaft, the crankshaft, a toothed belt, a V-belt, the drive for the water pump or for the generator, or the high-pressure fuel pump (13) of a fuel injection system.

16. The fuel supply system a claim 8 wherein the drive of the fuel pump (1) is effected on the engine side by the engine camshaft, the crankshaft, a toothed belt, a V-belt, the drive for the water pump or for the generator, or the high-pressure fuel pump (13) of a fuel injection system.

17. The fuel supply system of claim 1 wherein the fuel pump (1) is a roller cell pump or a geared pump.

18. The fuel supply system of claim 2 wherein the fuel pump (1) is a roller cell pump or a geared pump.

19. The fuel supply system of claim 3 wherein the fuel pump (1) is a roller cell pump or a geared pump.

20. The fuel supply system of claim 5 wherein the fuel pump (1) is a roller cell pump or a geared pump.

* * * * *